US005934474A

United States Patent [19]

Renninger et al.

[11] Patent Number: 5,934,474

[45] Date of Patent: Aug. 10, 1999

[54] COLLAPSIBLE PALLETIZED CONTAINER SYSTEM

[76] Inventors: Robert David Renninger, RR2 Box 132, Williamsport, Pa. 17701; Paul Christian Brown, 156 Scarboro Dr., York, Pa. 17403; Richard Dennis Owen, 5181 Terrace Dr., Baltimore, Md. 21236-4233

[21] Appl. No.: 08/964,847

[22] Filed: Nov. 5, 1997

[51] Int. Cl.[6] ..... B65D 19/20

[52] U.S. Cl. ..... 206/600; 108/51.3; 108/56.3; 229/117.07; 229/117.05

[58] Field of Search ..... 206/386, 600; 108/51.3, 56.3; 229/117.05, 117.06, 117.07

[56] References Cited

U.S. PATENT DOCUMENTS

| | | | |
|---|---|---|---|
| 3,119,547 | 1/1964 | Nute . | |
| 3,199,762 | 8/1965 | Coons . | |
| 3,642,192 | 2/1972 | Wilcox, Jr. et al. . | |
| 3,708,861 | 1/1973 | Hickey | 206/600 X |
| 3,770,186 | 11/1973 | Kupersmit . | |
| 4,100,859 | 7/1978 | Clark, Jr. . | |
| 4,373,637 | 2/1983 | Shippell . | |
| 4,545,482 | 10/1985 | Novatny . | |
| 4,606,461 | 8/1986 | Bolton, Sr. . | |
| 4,691,859 | 9/1987 | Snyder . | |
| 4,712,687 | 12/1987 | Silcott et al. . | |
| 4,793,507 | 12/1988 | Delplanque . | |
| 4,863,024 | 9/1989 | Booth . | |
| 4,880,141 | 11/1989 | Gossler et al. . | |
| 4,949,898 | 8/1990 | Nederveld . | |
| 4,969,559 | 11/1990 | Nederveld . | |
| 5,071,010 | 12/1991 | Carufel Zeman . | |
| 5,163,555 | 11/1992 | West et al. . | |
| 5,301,872 | 4/1994 | Tusing et al. . | |
| 5,318,219 | 6/1994 | Smith . | |
| 5,542,541 | 8/1996 | Smith | 206/600 |
| 5,601,232 | 2/1997 | Greenlee | 206/600 X |

FOREIGN PATENT DOCUMENTS

| | | | |
|---|---|---|---|
| 2027776 | 4/1992 | Canada | 206/600 |

*Primary Examiner*—Bryon P. Gehman

[57] ABSTRACT

A collapsible palletized container system for the containment of various articles including bulk materials. A container portion attached to a pallet including a relocation flap in the bottom panel of the container for the facilitation of collapsing the container from a deployed position while minimizing the overall height of the container in the collapsed orientation and maintaining the collapsed container entirely within the boundaries of the pallet.

23 Claims, 4 Drawing Sheets

COLLAPSIBLE PALLETIZED CONTAINER SYSTEM

BACKGROUND OF THE INVENTION

The present invention relates in general to a collapsible palletized container system and, in particular, to a collapsible container apparatus attached to a pallet so as to substantially facilitate the collapse of the container to a minimized profile, both vertically and horizontally, when storage of the system is required.

Pallets have been used for many years by shippers and transporters of various materials. These pallets typically provide a flat and sturdy surface on which materials can be placed and stacked. In order to assure that the materials remain on the pallet, various sized and shaped containers have been attached to the tops of pallets so as to present a bounded area in which to place and/or remove the materials being shipped or stored.

Containers that have been conventionally attached to pallets range from nothing more than four walls and a bottom which utilize the pallet top surface as support, to more intricate collapsible pallet/container combinations. Most early pallet container combinations were not collapsible and retained their shape, configuration and dimensions whether in use or not, thereby requiring excess space when stored between uses. Yet, other pallet/container combinations have involved collapsible container combinations.

Other configurations of pallet/container combinations allowed for the pallet and container to be formed out of different structural materials. Unfortunately, many such structures required excessive container material or extra space when not in use to accommodate high bulky collapsed structures or bulk-bin container panels that exceeded the periphery of the pallet, when collapsed. Typically, extra costs associated with floor space and height restrictions often proved prohibitive.

In most prior art pallet-container combinations, the larger the combination is, the less manageable it often becomes. Many such combinations require extensive time and effort to fully deploy the container portion of the combination. There is often a necessity to hold down one portion of the container while attempting to deploy another portion. This arrangement very often necessitates more than one individual to articulate and deploy the container, or conversely to collapse the combination after use.

The prior art pallet/container combinations include U.S. Pat. No. 5,301,872 to Tusing, et al.; U.S. Pat. No. 5,601,232 to Greenlee; U.S. Pat. No. 4,373,637 to Shippell; U.S. Pat. No. 5,071,010 to Carufel/Zeman; U.S. Pat. No. 4,969,559 to Nederveld; U.S. Pat. No. 4,949,898 to Nederveld; U.S. Pat. No. 4,793,507 to Delplanque; U.S. Pat. No. 4,880,141 to Gossler, et al.; U.S. Pat. No. 4,712,687 to Silcott, et al.; U.S. Pat. No. 4,606,461 to Bolton Sr.; and U.S. Pat. No. 4,545, 482 to Novatny. While this prior art relates in varying degrees to the present invention, many lack the many advantages of the present invention.

It is thus an object of the present invention to create an inexpensive, easy to assemble pallet/container apparatus that can be utilized with a variety of pallets and be formed into a variety of sizes and out of a variety of foldable materials that may be recyclable.

It is a further object of the invention to provide a container portion that requires a minimized amount of time and effort, by one individual, to deploy and collapse with few operational steps.

Similarly it is an object to minimize the amount of materials utilized to form the container portion and to minimize the overall vertical and horizontal profiles of the pallet/container combination when fully collapsed, and not in use, by minimizing the profile height of the container while maintaining the container within the outer peripheral boundaries of the pallet.

These and other objects of the invention will become apparent in light of present specification and drawings.

SUMMARY OF THE INVENTION

The present invention comprises a collapsible palletized container system which includes a container which is capable of being reoriented from a fully collapsed position during storage of the system to a fully deployed position during use of the system for the containment of various types of articles within the interior region of the container portion of this system. The container can be similarly reoriented to a collapsed position from its deployed position so as to minimize the profile of the container while maintaining the collapsed container within the periphery of the pallet.

In a preferred embodiment of the invention, the system comprises a pallet and a container portion attached to the top surface of the pallet. The container has a front, back and at least two side panels, each of which has upper and lower edges, as well as respective side edges, and which are hingedly attached to one another so as to form a contiguous outer periphery of the container. The at least two side panels of this embodiment contain members for inwardly folding the at least two side panels towards the interior region of the container, when the container is reoriented from its deployed position to its collapsed position.

In this preferred embodiment, the container further comprises a bottom panel which is foldably attached to the lower edge of either the front or back panel at the bottom panel's outer edge. The bottom panel is also bounded by an inner edge opposite to the outer edge and two side edges positioned therebetween and opposite one another. This bottom panel, further includes a relocation fold positioned within the bottom panel between the inner and outer edges of the bottom panel, thereby creating an attachment flap operably positioned between the relocation fold and the inner edge of the bottom panel as well as a relocation flap positioned between the relocation fold and the outer edge of the bottom panel. The outer surface of the attachment flap is restrainably attached to a portion of the top surface of the pallet. In contrast, the relocation flap is articulatable between a collapsed position in which its inner surface is overlapping at least a portion of the attachment flap, when the container is in its fully collapsed position, and a deployed position which is substantially 180° disposed from its prior collapsed position so that the outer surface of the relocation flap is juxtaposed onto a portion of the top surface of the pallet and substantially co-planer with the attachment flap. The relocation flap is positioned within the bottom panel, so as to permit the container to collapse to a minimal height within the periphery of and on top of the pallet while also permitting the front, back and at least two side panels to articulate into a container having an interior region substantially no greater than the periphery of the pallet.

Preferably, the at least two side panels comprise two side panels positioned opposite to each other and between the front and back panels so as to form a substantially rectangular shaped container as the container is fully deployed. This container also has a single bottom panel, a front bottom support flap and two size bottom support flaps. The bottom panel, front bottom support flap, and two side bottom support flaps are each hingedly attached to the respective lower edges of the back panel, front panel, and two side panels. The bottom panel, front bottom support flap, and two side bottom support flaps cooperate towards forming a first and second level floor for the container when the container is fully deployed. The floors' position is intended to be maintained in place by the weight of the articles put within the container. Alternatively, the floors' position may be maintained in place through various closure mechanisms in the prior art. Each of the front bottom support flaps and two side bottom support flaps are capable of pivoting from a position overlapping at least a portion of each respective front and two side panels when the container is in the collapsed position to a deployed position substantially perpendicular to the respective front and two side panels. It is anticipated, that the front bottom support flap will be deployed so as to be positioned directly upon the top surface of the pallet while the side bottom support flaps will then be deployed directly on top of the front bottom support flap and the bottom panel. Simply put, the bottom panel and front bottom support flap will be sandwiched between the top surface of the pallet and the two side bottom support flaps when the container is in its deployed position.

Of course, the container can be of any size so long as it cooperates with the particular pallet. However, to optimize the amount of interior region of the container and therefore the carrying capacity of the system, it is preferred that the front, back and side panels forming the container be positioned along and congruent with the pallet's outer periphery upon full deployment. Additionally, in the preferred embodiment, each of the side panels has a single articulation fold which extends from the side panel's upper edge to its lower edge and substantially bisects the respective side panels and facilitates the side panels collapsed.

The container itself can be formed out of a single unitary blank of material, or out of two blanks of material. In such a construction, the first blank of material would include the back panel, bottom panel, a first side panel, a first side bottom support flap, and an integration flap. Similarly, the second blank of material would include a front panel, a front bottom support flap, a second side panel, a second side bottom support flap and a second integration flap. The two blanks of material would be constructed so that the integration flaps would emanate from the back and front panels respectively. Accordingly, when formed into the contiguous container the integration flaps would serve to connect the back panel of the first blank of material to the side panel of the second blank of material as well as the front panel of the second blank of material to the side panel of the first blank of material.

Moreover, the system may be formed out of a variety of materials. While the pallet and the container need not be constructed from the same material, it is envisioned that the container be constructed out of a substantially biodegradable paperboard material, preferably corrugated paperboard. The pallet may be similarly formed from corrugated paperboard material or may comprise a combination of materials hen necessary for structural reinforcement. Such reinforcing materials may include plastic.

It is envisioned that a preferred embodiment of the invention also includes a cover which is capable of being positioned over the collapsed system so that the sides of the cover extend down over the collapsed container past the top surface of the pallet. This cover may also be used to cap the top of the deployed container so as to enclose the interior region of the container.

In a preferred embodiment, the method of deploying a collapsible palletized container system comprises the steps of (a) forming a container apparatus having a front panel, a back panel, two side panels, a bottom panel, two side bottom support flaps and a front bottom support flap, each of which said front, back and side panels having an upper, a lower and two side edges and are hingedly attached to one another, in succession, at respective side edges and said bottom panel, said two side bottom support flaps and said front bottom support flap hingedly attached to said back panel, said two side panels and said front panel at said respective lower edges; (b) folding said bottom panel along a bottom panel fold line to form an attachment flap and a relocation flap; (c) attaching said attachment flap of said bottom panel to the surface of a pallet; (d) pivoting said relocation flap along said bottom panel fold line to relocate said relocation flap to a position 180° disposed to said attachment flap, and adjacent to said attachment flap, to overlap at least a portion of said pallet; (e) deploying said container apparatus so that said container apparatus is in a substantially rectangular configuration; (f) pivoting said two side bottom support flaps along respective fold lines at said lower edges of said two side panels to a position substantially perpendicular to each respective said side panel; (g) pivoting said front bottom support flap along a fold line at said lower edge of said front panel to a position substantially perpendicular to said front panel; and (h) pivoting said back panel along a fold line at the junction between said relocation flap and said lower edge of said back panel to a position substantially perpendicular to said bottom panel and said pallet. The method may also include the step of covering said container portion at said upper edges of said front, back and two side panels.

DETAILED DESCRIPTION OF THE DRAWINGS

Figure 1:
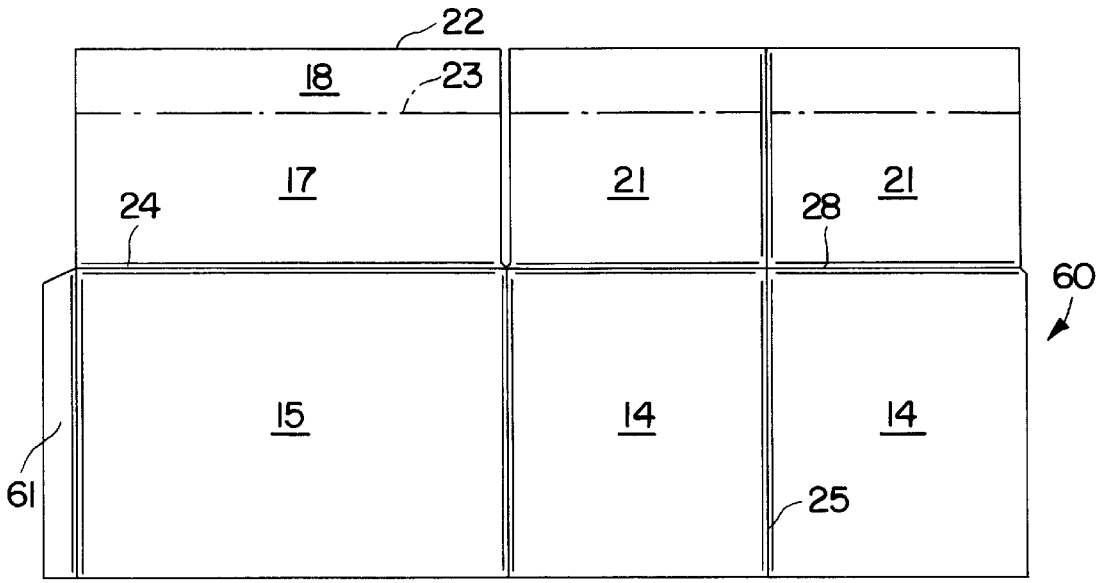
FIG. 1 is an elevated view of a non-articulated, integrated container blank, comprising a single sheet of unitary material containing a back panel, a side panel, a bottom panel, a side bottom support flap and an integration flap, two of which sheets form a single container.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Collapsible palletized container system 10 of the present invention is shown in FIGS. 2 through 7. System 10 comprises pallet 11 and container 12 which is attached thereto. Container 12 comprises front panel 13, two side panels 14 and 16, back panel 15, bottom panel 17–18, front bottom support flap 19 and two side bottom support flaps 21 and 22.

Figure 2:
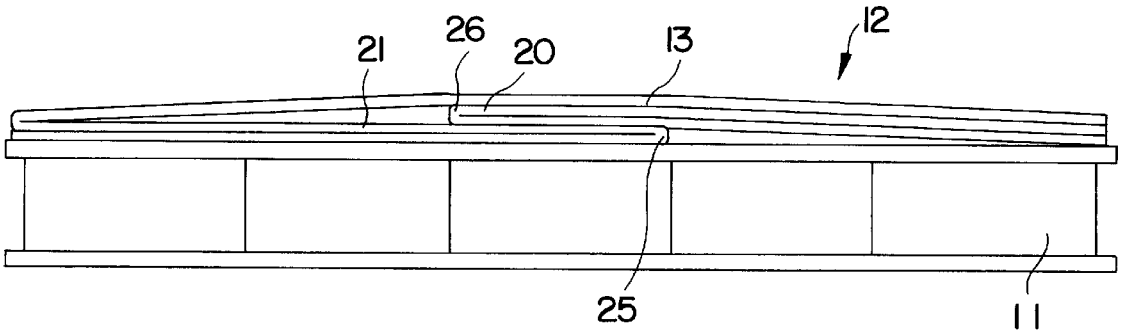
FIG. 2 is an elevated front view of the container folded in on itself in a fully collapsed orientation so as to minimize the overall height of the container as collapsed upon the top surface of the pallet.

FIG. 2 demonstrates system 10 in its initial and completely collapsed position for storage of the system during non-use. As such, container 12 is folded into itself and collapsed to a minimal overall height while remaining completely within the peripheral boundaries of pallet 11. Sandwiched between the top surface of pallet 11 and the co-planar combination of front panel 13 and front bottom support flap 19 are remaining panels back panel 15, side panels 14 and 16 and bottom panel 17–18 as well as the two side support flaps 21 and 22. As sequentially shown in FIGS. 2 through 6, container 12 unfolds from its completely collapsed and storing position of FIG. 2 to a fully deployed and utilitarian position of FIG. 6.

Figure 3:
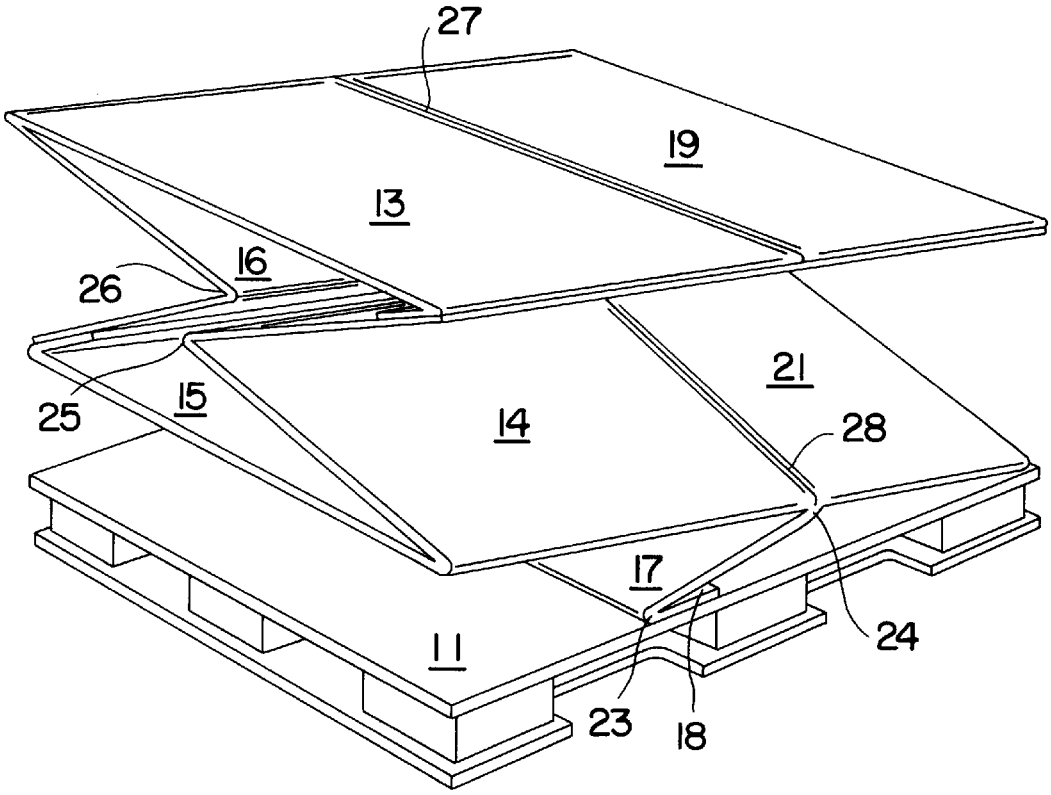
FIG. 3 is a perspective view of the pallet/container system in which the container is shown being preliminarily deployed from its fully collapsed position on the pallet towards its deployed position.

Specifically, container 12 expands by moving front panel 13 away from pallet 11 thereby initiating deployment of container 12 as in FIG. 3. The movement of front panel 13 similarly causes the deployment of side panels 14 and 16 inasmuch as side panels 14 and 16 are hingedly attached to front panel 13 at side edges 30 and 31. Therefore, side panels 14 and 16 transition from a collapsed position in FIG. 2 to a fully deployed position seen in FIG. 4. Articulation folds 25 and 26 are operably positioned within side panels 14 and 16 to facilitate both the deployment of side panels 14 and 16 from the collapsed position and the collapse of side panels 14 and 16 from deployed positions. Articulation folds 25 and 26 which extend the length of side panels 14 and 16, respectively, and substantially bisect the respective side panels. During development of container 12 articulation folds 25 and 26 move away from the interior region of container 12 and each other. Conversely, when container 12 is reoriented from a deployed position to a collapsed position, articulation folds 25 and 26 move towards the interior region of container 12 to, in turn, facilitate the collapse of side panels 14 and 16.

Figure 6:
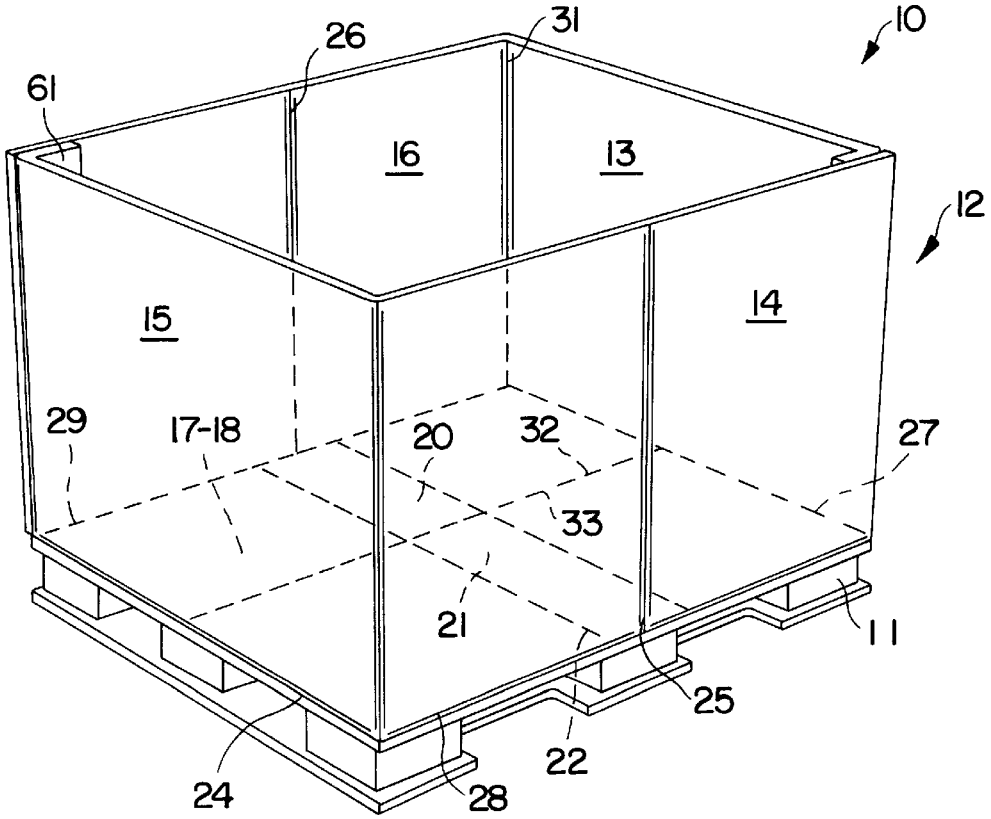
FIG. 6 is a perspective view of a fully deployed pallet/container system in which the bottom panel and the front bottom support flap of the container are substantially co-planar to each other, with each overlaying a portion of the top surface of the pallet.
Figure 5:
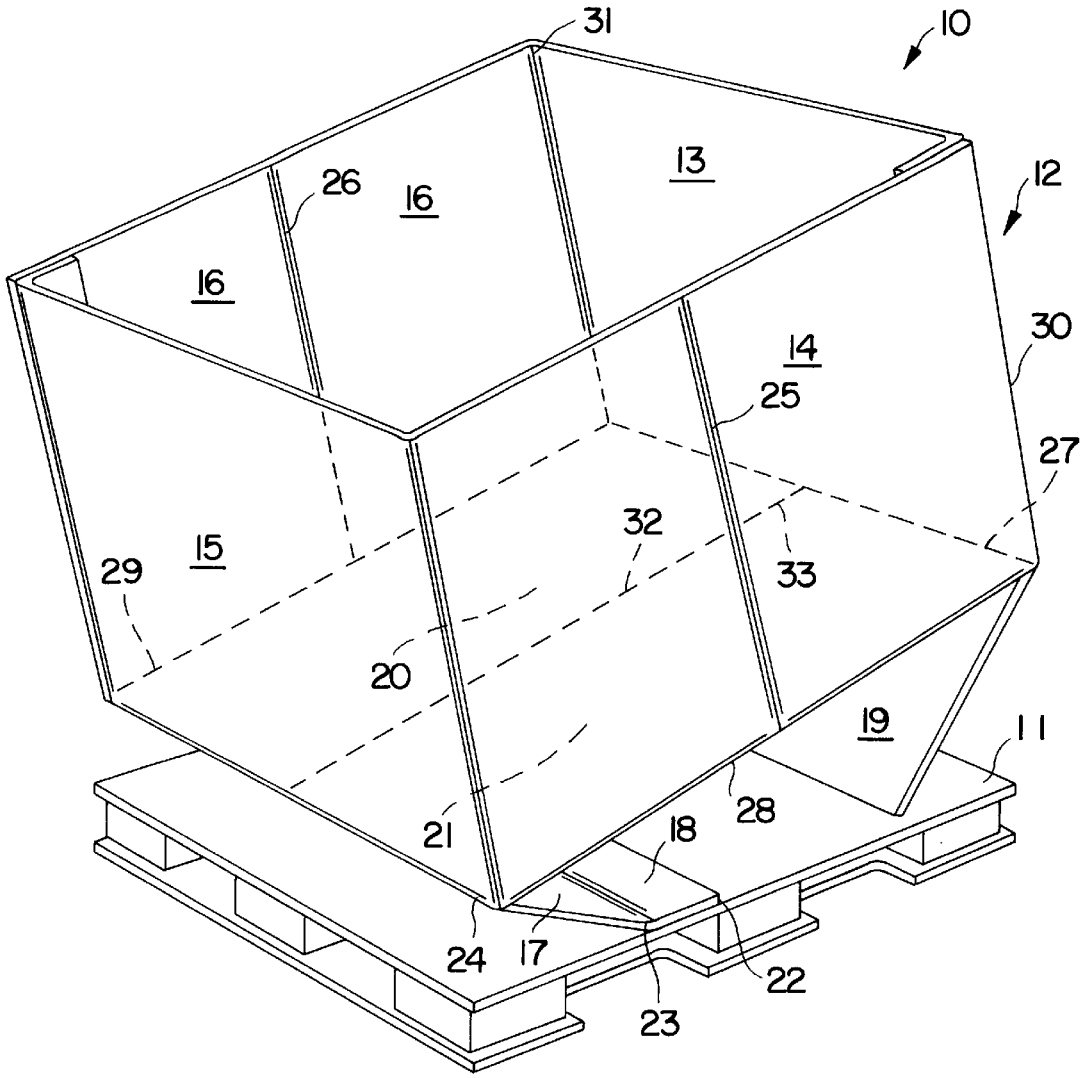
FIG. 5 is a perspective view of the container in which the two side bottom support flaps have been reoriented from their respective collapsed positions to their respective deployed positions substantially perpendicular to the respective side panels, and in which the front bottom support flap is shown transitioning from its collapsed position to its deployed position.
Figure 4:
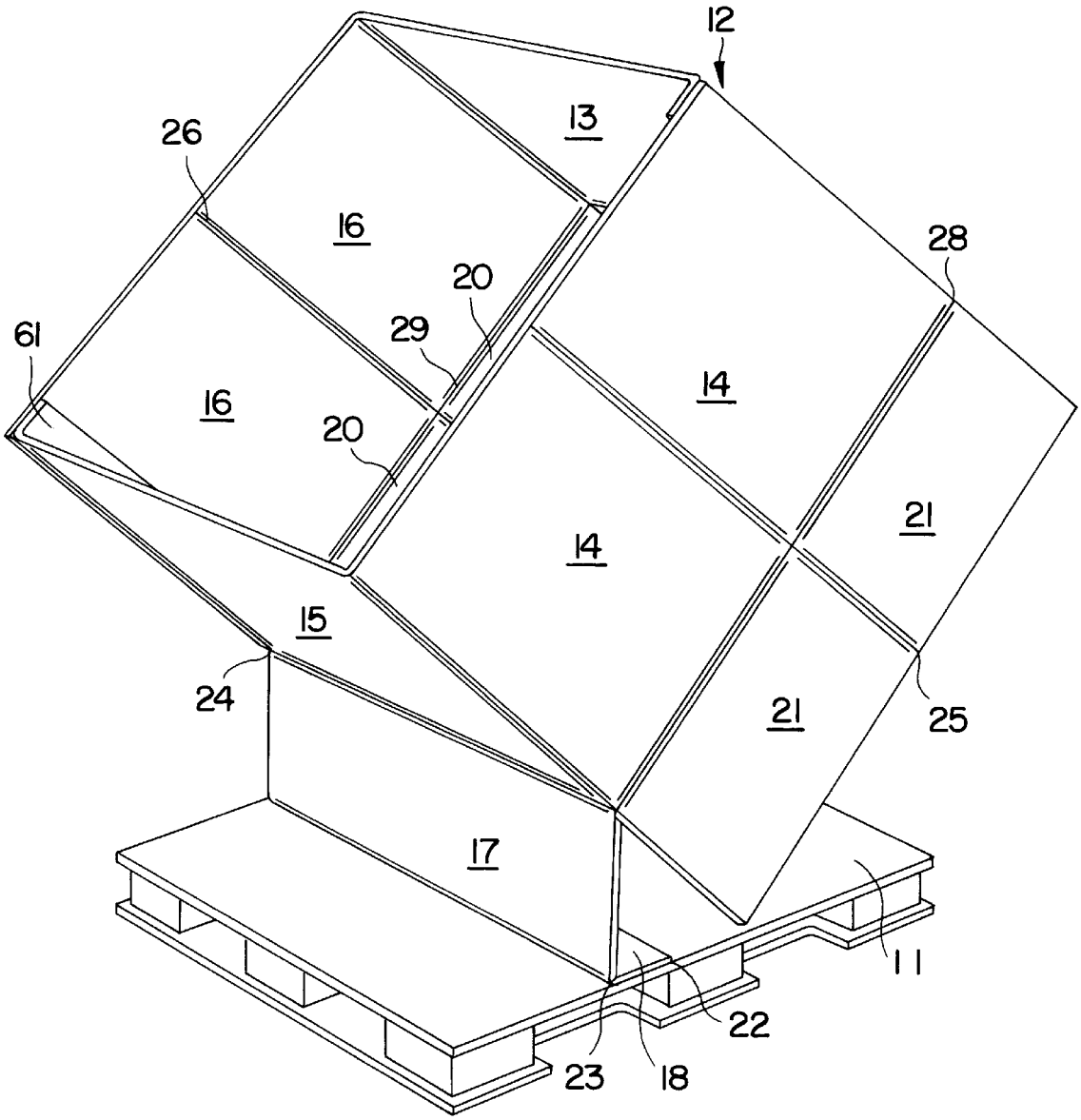
FIG. 4 is a perspective view of the container in which the front, back and side panels of the container are completely articulated so that the container assumes its substantially rectangular shape.

Turning back to deployment of container 12, bottom panel 17–18 is comprised of two portions, namely relocation flap 17 and attachment flap 18. During deployment, relocation flap 17 pivots 180° about relocation fold 23 from a collapsed position in which relocation flap 17 overlaps at least a portion of attachment flap 18 as shown in FIG. 3 to a fully deployed position in which relocation flap 17 overlays at least a portion of the top surface of pallet 11 as shown in FIGS. 4 and 5 so as to ultimately transition to a position substantially co-planar with attachment flap 18 as shown in FIG. 6. Attachment flap 18 remains attached to pallet 11 thereby keeping container 12 attached to pallet 11 while system 10 is in both the deployed and collapsed orientation.

Side bottom support flaps 21 and 20 begin in a position substantially co-planar with respective side panels 14 and 16 when container 12 is in a collapsed or partially collapsed position as in FIGS. 3 and 4 and ultimately transition by folding about lower edges 28 and 29 to a position substantially perpendicular to side panels 14 and 16 when container 12 is fully deployed as in FIG. 6. Similarly, front bottom support flap 19 folds approximately 90° about lower edge 27 from a position substantially co-planar with front panel 13 when container 12 is collapsed to position substantially perpendicular to front panel 13 and substantially co-planar to bottom panel 17–18, as shown in FIGS. 3 through 6.

When container 12 is fully deployed as shown in FIG. 6, front panel 13, back panel 15 and side panels 14 and 16 are all vertically oriented so as to be substantially perpendicular to pallet 11 with two side panels 14 and 16 and front panel 13 and back panel 15 each being substantially parallel to the respective opposing panels so as to form a substantially rectangular shaped container. While not required, it is preferable that inner edges 32 and 33 of side bottom support flaps 20 and 21 meet when side bottom support flaps 20 and 21 are in a deployed position thereby forming a first level floor to container 12. A second outer level floor may also be formed if inner edge 22 of bottom panel 17–18 meets inner edge 34 of front bottom support flap 19 when container 12 is deployed and ultimately positioned upon pallet 11. It is contemplated that the positions of bottom panel 17–18, side bottom support flaps 20 and 21, and front bottom support flap 19 would be maintained in their respective positions by the weight of the articles placed within the interior region of container 12. Alternatively, their respective positions could be maintained by various prior art licking mechanisms. Furthermore, to maximize the interior region of container 12 formed by front panel 13, side panels 14 and 16 and back panel 15, front panel 13, side panels 14 and 16 and back panel 15 are positioned so that their respective lower edges 27–29 and 24 ring the outer peripheral boundaries of the top surface of pallet 11.

Figure 7:
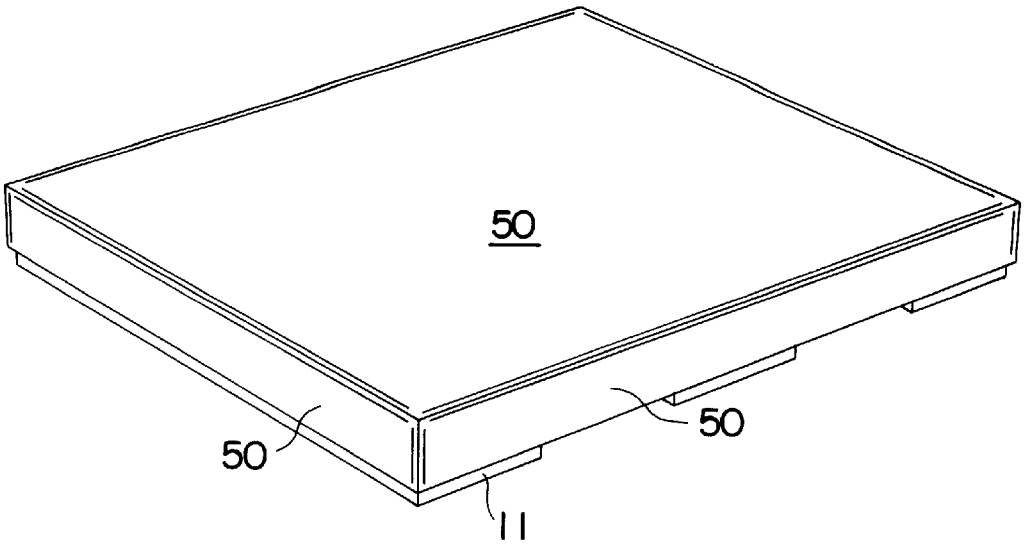
FIG. 7 is perspective view of a completely collapsed system further including a cover which encloses the collapsed container and pallet thereby protecting the system, towards maintaining the system in its collapsed position during storage and non-use.

Shown in FIG. 7 is system 10 fully collapsed as in FIG. 2 with a cover 50 place over the system. Cover 50 is positioned over system 10 so as to completely enclose collapsed container 12 and substantially enclosed pallet 11 within its side panels as shown at 56 and 57. Cover 50 may similarly be used to cap container 12 when in its fully deployed position of FIG. 6 so as to be capable of sealing the interior region of container 12.

FIG. 1 shows a first container blank 60 for formation of container 12 in which side panel 14 is bisected by articulation fold 25 and hingedly attached to back panel 15 as well as hingedly attached to side bottom support flap 21. In addition to being hingedly attached to side panel 14, back panel 15 is hingedly attached to relocation flap 17 at relocation fold 23 which, in turn, is hingedly attached to attachment flap 18. Integration flap 61 is also included in blank 60 as hingedly attached to back panel 15 so as to attach to and overlay front panel 13 which is within a similar second blank of material, not shown, to form container 12. Two blanks of material such as that shown in FIG. 1, may be used in cooperation to form container 12. Alternatively, container 12 may be formed from a single continuous blank of material which incorporates the features of the two blanks contemplated in FIG. 1.

The foregoing description and drawings merely explain and illustrate the invention and the invention is not limited thereto except as the appended claims are so limited, as those skilled in the art who have the disclosure before them will be able to make modifications and variations therein without departing from the scope of the invention.

We claim:

1. A collapsible palletized container system including a container apparatus which is capable of being reoriented from an articulated collapsed position for storage of said system to an articulated deployed position for containment of articles therewithin and back again to said collapsed position after such use, said container apparatus further being configured and oriented to present a minimal, flat collapsed profile substantially within the lateral periphery of a pallet, said system comprising:

a pallet for supporting and moving said container apparatus, said pallet having a top surface upon which said container apparatus is positionable and a bottom surface upon which said pallet and container apparatus rests upon contact with a supporting surface;

said container apparatus including a front panel, a back panel and at least two side panels, each of which said front, back and at least two side panels having an upper edge, a lower edge opposite said upper edge and two side edges positioned opposite to each other between said upper and lower edges respectively;

each of said side edges of said front, back and at least two side panels being operably and hingedly attached to one another respectively in succession;

means for articulating said at least two side panels so as to fold each of said at least two side panels inwardly towards an interior region of said container apparatus upon reconfiguration of said container apparatus from said deployed position to said collapsed position;

said container apparatus further including only one bottom panel foldably attached to said lower edge of one of said front and back panels, said one bottom panel having an outer edge at which said one bottom panel is foldably attached to said lower edge of one of said front and back panels, an inner edge opposite said outer edge and two side edges operably positioned between said inner and outer edges of said one bottom panel, said two side edges being positioned opposite one another, said one bottom panel enclosing only a portion of the bottom of said apparatus in its articulated deployed position, said one bottom panel including a relocation fold operably positioned within said bottom panel at a position between said bottom panel inner edge and outer edge, to create an attachment flap between said relocation fold and said inner edge and a relocation flap between said relocation fold and said outer edge, said attachment flap being operably attached along its outer surface to at least a portion of said top surface of said pallet;

said relocation flap being articulatable between said collapsed position in which the inner surface of said relocation flap is juxtaposed to and overlapping at least a portion of said attachment flap when said container apparatus is in its collapsed position and a deployed position substantially 180° disposed from said collapsed position in which the outer surface of said relocation flap is juxtaposed to at least a portion of said top surface of said pallet, adjacent to the position of said attachment flap on said top surface of said pallet;

said relocation flap enabling substantially the entirety of said container apparatus to be collapsed to a minimal height profile, substantially within said lateral periphery of said pallet, on said top surface of said pallet, while said container apparatus is in its collapsed position; while substantially relocating said front, back and at least two side panels to upright articulated positions while creating said interior region, said upright articulated positions being oriented in a region substantially no greater than said lateral periphery of said pallet, respectively, while said container apparatus is in its deployed position.

2. The collapsible palletized container system according to claim 1 in which:

said at least two side panels comprise two side panels operably positioned opposite each other and between said front and back panels so said side edges of said front, back and two side panels are attached to one another respectively, in succession, so as to form said container apparatus into a substantially rectangular shape; and said bottom panel comprises a single bottom panel foldably attached to said lower edge of one of said front and said back panels.

3. The collapsible palletized container according to claim 2 in which said bottom panel is foldably attached to said lower edge of said back panel.

4. The collapsible palletized container system according to claim 2 wherein said container apparatus further includes a front bottom support flap, which foldably attaches to said lower edge of one of said front and back panels not attached to said bottom panel so as to be pivotable from a collapsed position when said container apparatus is in said collapsed position to a deployed position, substantially 90° disposed from said collapsed position so as to be substantially parallel to and overlapping a portion of said top surface of said pallet when said container apparatus is in said deployed position.

5. The collapsible palletized container system according to claim 4 wherein said container apparatus further includes two side bottom support flaps, each of which are foldably attached to said lower edge of said respective two side panels so as to be pivotable from a collapsed position when said container apparatus is in said collapsed position, to a deployed position substantially 90° disposed from said collapsed position so as to be substantially parallel to and overlapping at least one of a portion of one of said bottom panel, said front bottom support flap, and said top surface of said pallet, when said container apparatus is in said deployed position.

6. The collapsible palletized container system according to claim 5 in which said container apparatus is operably formed out of first and second blanks of foldable material;

said first blank of foldable material including said back panel, said bottom panel, a first of said two side panels, a first of said two side bottom support flaps, and a first integration flap foldably attached to one side edge of said back panel; and said second blank of foldable material including said front panel, said front bottom support flap, a second of said two side panels, a second of said two side bottom support flap, and a second integration flap foldably attached to one side edge of said front panel.

7. The collapsible palletized container system according to claim 5 in which said container apparatus is operably formed out a single blank of foldable material.

8. The collapsible palletized container system according to claim 2 wherein said container apparatus further includes two side bottom support flaps, each of which is foldably attached to said lower edge of a respective one said two side panels so as to be pivotable from a collapsed position when said container apparatus is in said collapsed position, to a deployed position substantially 90° disposed from said collapsed position so as to be substantially parallel to and overlapping at least one of a portion of one of said bottom panel and said top surface of said pallet when said container apparatus is in said deployed position.

9. The collapsible palletized container system according to claim 1 in which the lateral periphery of said container apparatus created by said front, back and at least two side panels upon relocating said front, back and at least two side panels from said collapsed positions to upright articulated positions while said container apparatus is in its deployed position is substantially equal and congruent to said lateral periphery of said pallet.

10. The collapsible palletized container system according to claim 1 in which said means for articulating said at least two side panels comprise at least one articulation fold operably positioned within each of said at least two side panels, each of said articulation folds extending substantially from said respective upper edge to said lower edge of each respective side panel, and positioned substantially midway between said respective side edges of said each respective side panel so as to divide each of said at least two side panels substantially in half.

11. The collapsible palletized container system according to claim 1 wherein said system further includes a cover apparatus for covering, maintaining and protecting said system in said collapsed position during storage of said system, said cover apparatus including a top panel having four top side edges, and four top side panels hingedly attached to respective ones of said four top side edges, and each of said four top side panels being positioned substantially perpendicular to said top panel, said top panel further having a lateral periphery substantially equal to said lateral periphery of said pallet to, in turn, enable said side panels of said cover to substantially enclose the entirety of said collapsible palletized container system when said cover is operably positioned upon said collapsed container apparatus when said systems is in said collapsed position.

12. The collapsible palletized container system according to claim 11 in which said lateral periphery of said top panel of said cover is dimensioned substantially equal to said lateral periphery of said container apparatus when said container apparatus is in said deployed position to, in turn, enclose said interior region of said container apparatus during said containment of articles therewithin.

13. The collapsible palletized container system according to claim 1 in which said container apparatus is formed from substantially biodegradable material.

14. The collapsible palletized container system according to claim 13 in which said pallet is formed from substantially biodegradable material.

15. The collapsible palletized container system according to claim 13 in which said pallet is formed from paperboard material.

16. The collapsible palletized container system according to claim 13 in which said container apparatus is formed from corrugated paperboard material.

17. The collapsible palletized container system according to claim 1 in which said pallet is formed from of a combination of plastic and paperboard material.

18. A method for articulating and deploying a collapsible palletized container system, the method comprising the steps of:

forming a container apparatus having a front panel, a back panel, two side panels, a bottom panel capable of enclosing only a portion of the container apparatus bottom upon deployment, two side bottom support flaps and a front bottom support flap capable of enclosing the remainder of the bottom of the container apparatus upon deployment, each of which said front, back and side panels having an upper, a lower and two side edges and are hingedly attached to one another, in succession, at respective side edges and said bottom panel, said two side bottom support flaps and said front bottom support flap hingedly attached to said back panel, said two side panels and said front panel at said respective lower edges;

folding said bottom panel along a bottom panel fold line to form an attachment flap and a relocation flap;

attaching only said attachment flap of said bottom panel to the surface of a pallet;

pivoting said relocation flap along said bottom panel fold line to relocate said relocation flap to a position 180° disposed to said attachment flap, and adjacent to said attachment flap, to overlap at least a portion of said pallet;

deploying said container apparatus so that said container apparatus is in a substantially rectangular configuration;

pivoting said two side bottom support flaps along respective fold lines at said lower edges of said two side panels to a position substantially perpendicular to each respective said side panel;

pivoting said front bottom support flap along a fold line at said lower edge of said front panel to a position substantially perpendicular to said front panel; and pivoting said back panel along a fold line at the junction between said relocation flap and said lower edge of said back panel to a position substantially perpendicular to said bottom panel and said pallet.

19. The method of claim 18 further comprising the step of covering said container portion at said upper edges of said front, back and two side panels.

20. A collapsible palletized container system including a container apparatus which is capable of being reoriented from an articulated collapsed position for storage of said system to an articulated deployed position for containment of articles therewithin and back again to said collapsed position after such use, said container apparatus further being configured and oriented to present a minimal, flat collapsed profile substantially within the lateral periphery of a pallet, said system comprising:

a pallet for supporting and moving said container apparatus, said pallet having a top surface upon which said container apparatus is positionable and a bottom surface upon which said pallet and container apparatus rests upon contact with a supporting surface;

said container apparatus including a front panel, a back panel and two side panels, each of which said front, back and two side panels having an upper edge, a lower edge opposite said upper edge and two side edges positioned opposite to each other between said upper and lower edges respectively;

each of said side edges of said front, back and two side panels being operably and hingedly attached to one another respectively in succession;

said two side panels operably positioned opposite each other and between said front and back panels so said side edges of said front, back and two side panels are attached to one another respectively, in succession, so as to form said container apparatus into a substantially rectangular shape; and means for articulating said two side panels so as to fold each of said two side panels inwardly towards an interior region of said container apparatus upon reconfiguration of said container apparatus from said deployed position to said collapsed position;

said container apparatus further including a single bottom panel foldably attached to said lower edge of one of said front and back panels, said bottom panel having an outer edge at which said bottom panel is foldably attached to said lower edge of one of said front and back panels, an inner edge opposite said outer edge and two side edges operably positioned between said inner and outer edges of said bottom panel, said two side edges being positioned opposite one another, said bottom panel including a relocation fold operably positioned within said bottom panel at a position between said bottom panel inner edge and outer edge, to create an attachment flap between said relocation fold and said inner edge and a relocation flap between said relocation fold and said outer edge, said attachment flap being operably attached along its outer surface to at least a portion of said top surface of said pallet;

said relocation flap being articulatable between said collapsed position in which the inner surface of said relocation flap is juxtaposed to and overlapping at least a portion of said attachment flap when said container apparatus is in its collapsed position and a deployed position substantially 180° disposed from said collapsed position in which the outer surface of said relocation flap is juxtaposed to at least a portion of said top surface of said pallet, adjacent to the position of said attachment flap on said top surface of said pallet;

said relocation flap enabling substantially the entirety of said container apparatus to be collapsed to a minimal height profile, substantially within said lateral periphery of said pallet, on said top surface of said pallet, while said container apparatus is in its collapsed position; while substantially relocating said front, back and two side panels to upright articulated positions while creating said interior region, said upright articulated positions being oriented in a region substantially no greater than said lateral periphery of said pallet, respectively, while said container apparatus is in its deployed position;

said container apparatus further including a front bottom support flap, which foldably attaches to said lower edge of one of said front and back panels not attached to said bottom panel so as to be pivotable from a collapsed position when said container apparatus is in said collapsed position to a deployed position, substantially 90° disposed from said collapsed position so as to be substantially parallel to and overlapping a portion of said top surface of said pallet when said container apparatus is in said deployed position.

21. The collapsible palletized container system according to claim 20 wherein said container apparatus further includes two side bottom support flaps, each of which is foldably attached to said lower edge of said respective two side panels so as to be pivotable from a collapsed position when said container apparatus is in said collapsed position, to a deployed position substantially 90° disposed from said collapsed position so as to be substantially parallel to and overlapping at least one of a portion of one of said bottom panel, said front bottom support flap, and said top surface of said pallet, when said container apparatus is in said deployed position.

22. The collapsible palletized container system according to claim 21 in which said container apparatus is operably formed out of first and second blanks of foldable material;

said first blank of foldable material including said back panel, said bottom panel, a first of said two side panels, a first of said two side bottom support flaps, and a first integration flap foldably attached to one side edge of said back panel; and said second blank of foldable material including said front panel, said front bottom support flap, a second of said two side panels, a second of said two side bottom support flap, and a second integration flap foldably attached to one side edge of said front panel.

23. The collapsible palletized container system according to claim 21 in which said container apparatus is operably formed out of a single blank of foldable material.

* * * * *